US011110722B2

(12) United States Patent
Leo et al.

(10) Patent No.: US 11,110,722 B2
(45) Date of Patent: Sep. 7, 2021

(54) SYSTEM FOR DIRECTLY PRINTING FIBROUS OBJECTS WITH SOLID INK IMAGES

(71) Applicant: Xerox Corporation, Norwalk, CT (US)

(72) Inventors: Michael F. Leo, Penfield, NY (US); Wayne A. Buchar, Bloomfield, NY (US); Brendan C. Casey, Webster, NY (US); Daniel J. McVeigh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 85 days.

(21) Appl. No.: 16/668,356

(22) Filed: Oct. 30, 2019

(65) Prior Publication Data

US 2020/0189293 A1 Jun. 18, 2020

Related U.S. Application Data

(60) Provisional application No. 62/779,785, filed on Dec. 14, 2018.

(51) Int. Cl.

| | |
|---|---|
| ***B41J 3/407*** | (2006.01) |
| ***B41J 3/54*** | (2006.01) |
| ***B41J 2/135*** | (2006.01) |
| ***B41F 17/28*** | (2006.01) |
| ***B41F 17/00*** | (2006.01) |
| ***B41F 23/00*** | (2006.01) |
| ***B41F 17/18*** | (2006.01) |
| ***B41M 1/40*** | (2006.01) |

(52) U.S. Cl.

CPC ..... *B41J 3/4073* (2013.01); *B41F 17/002* (2013.01); *B41F 17/18* (2013.01); *B41F 17/28* (2013.01); *B41F 23/005* (2013.01); *B41F 23/007* (2013.01); *B41J 2/135* (2013.01); *B41J 3/40733* (2020.08); *B41J 3/543* (2013.01); *B41M 1/40* (2013.01); *B41P 2217/61* (2013.01)

(58) Field of Classification Search

CPC ..... B41F 17/18; B41F 17/28; B41J 3/4073; B41J 3/40733; B41M 1/40

See application file for complete search history.

(56) References Cited

U.S. PATENT DOCUMENTS

| | | | | |
|---|---|---|---|---|
| 4,392,565 | A | 7/1983 | Strauch | |
| 9,375,927 | B1 | 6/2016 | Perego | |
| 10,124,614 | B1 | 11/2018 | Leo et al. | |
| 10,214,026 | B1 | 2/2019 | Jaskowiak et al. | |
| 10,414,179 | B2 * | 9/2019 | Leo | B41J 25/001 |
| 10,710,377 | B2 * | 7/2020 | Leo | B41J 11/002 |
| 2012/0098914 | A1 | 4/2012 | Dubuit et al. | |
| 2012/0274695 | A1 | 11/2012 | LaCaze et al. | |
| 2012/0306987 | A1 * | 12/2012 | Kim | B41J 3/4073 347/224 |
| 2015/0138295 | A1 | 5/2015 | Lindner et al. | |
| 2018/0326766 | A1 * | 11/2018 | Leo | B41J 3/4073 |

* cited by examiner

*Primary Examiner* — Leslie J Evanisko

(74) *Attorney, Agent, or Firm* — Maginot Moore & Beck LLP

(57) ABSTRACT

A printer includes a spindle that rotates a fibrous object opposite a plurality of printheads while a forced air heater directs heated air toward the surface of the fibrous object. The plurality of printheads eject drops of solid ink onto the surface of the fibrous object to form a solid ink image on the fibrous object and the heated air affixes the solid ink image to the surface of the fibrous object without requiring pressure to affix the solid ink image to the fibrous object.

14 Claims, 4 Drawing Sheets

SYSTEM FOR DIRECTLY PRINTING FIBROUS OBJECTS WITH SOLID INK IMAGES

PRIORITY CLAIM

This utility application claims priority benefit to U.S. Provisional Patent Application 62/779,785, which is entitled "System For Directly Printing Fibrous Objects With Solid Ink Images" that was filed on Dec. 14, 2018.

TECHNICAL FIELD

This disclosure relates generally to a system for printing on three-dimensional (3D) objects, and more particularly, to systems for printing on fibrous objects to be used for serving foods and beverages.

BACKGROUND

Coffee shops, fast food establishments, or the like, are environments in which customers order combinations of ingredients that are unique to their orders and the customer's name is frequently used to identify the cup in which the beverage is made and served. In some shops, the ingredients are also marked on the side of the cup and used by the barrister or food server to prepare the order. While hand written names and ingredients may be effective, the ability to print this information on the cups, bowls, or other food containers would enhance the legibility of the information and the professional appearance of the containers.

Direct-to-object (DTO) printers have been developed to enable custom printing of one or more objects at a time. These printers, however, are not conducive for food service environments. Many of these printers use ultraviolet (UV) radiation curable inks. In order to remain color fast, these inks must be cured with UV light. When these UV inks are printed on fibrous objects, such as paper cups and bowls typically used in food and beverage businesses, they quickly penetrate the surface and are shield from the UV radiation. Consequently, they do not cure and can migrate into the cup. Since these inks are not approved for packages used for food storage, they cannot be used for containers where they can potentially contact the food or beverage in the printed container.

Solid inks are inks that are loaded into printers in solid form and then heating to a melting point so the liquid ink can be supplied to printheads for forming ink images. While these inks have been approved for containers in which food can be stored, they are not amenable for use in DTO printers because they require pressure to affix the ink to the surfaces to which they are applied. Applying pressure to food containers that are ready to receive their contents would adversely impact the structural integrity of the containers and make them unfit for their intended use. What would be beneficial is to be able to incorporate solid ink in a DTO printer so food and beverage containers could be custom printed in a food service environment.

SUMMARY

A new printing system is configured to print the surface of fibrous objects with solid ink images one object at a time. The printing system includes a plurality of printheads, each printhead in the plurality of printheads being configured to eject solid ink marking material, a holder configured to hold a stack of nested objects, a spindle configured for reciprocal movement, an actuator operatively connected to the spindle to enable the actuator to move the spindle within an orifice of the object in the stack of nested objects that is closest to the plurality of printheads to engage the object and to move the object to a position opposite the plurality of printheads, a forced air heater configured to direct heated air toward the position opposite the plurality of printheads, and a controller operatively connected to the plurality of printheads, the conveyor, the forced air heater, and the actuator. The controller is configured to operate the actuator to move the spindle within the orifice of the object in the stack of nested objects that is closest to the plurality of printheads to engage the object, remove the object from the stack, and move the object to a position opposite the plurality of printheads, to operate the forced air heater to direct heated air toward the surface of the object opposite the plurality of heaters, and to operate the plurality of printheads to eject marking material onto the object on the spindle as the forced air heater directs heated air on the surface of the object.

Another embodiment of the new printing system includes a plurality of printheads, each printhead in the plurality of printheads being configured to eject solid ink marking material, a holder configured to hold an object, a spindle configured for reciprocal movement, an actuator operatively connected to the spindle to enable the actuator to move the spindle within an orifice of the object to engage the object in the holder, a forced air heater, and a controller operatively connected to the plurality of printheads, the forced air heater, and the actuator. The controller is configured to operate the actuator to move the spindle within the orifice of the object to engage the object and move the object to a position opposite the plurality of printheads, to operate the forced air heater to direct heated air toward a surface of the object, to operate the plurality of printheads to eject solid ink marking material onto the surface of the object as the forced air heater directs heated air toward the surface of the object, and to operate the actuator to move the spindle in response to printing of the object being completed to return the object to the holder.

A new method of printing the surface of a three-dimensional (3D) object includes operating an actuator with a controller to move a spindle within an orifice of an object in a holder to a position opposite a plurality of printheads configured to eject solid ink drops, operating a forced air heater with the controller to direct heated air toward a surface of the object, and operating the plurality of printheads with the controller to eject drops of the solid ink marking material onto the surface of the object on the spindle as the forced air heater directs heated air toward the surface of the object.

BRIEF DESCRIPTION OF THE DRAWINGS

The foregoing aspects and other features of a printing system that prints surfaces of objects useful for food service one object at a time are explained in the following description, taken in connection with the accompanying drawings.

DETAILED DESCRIPTION

Figure 1:
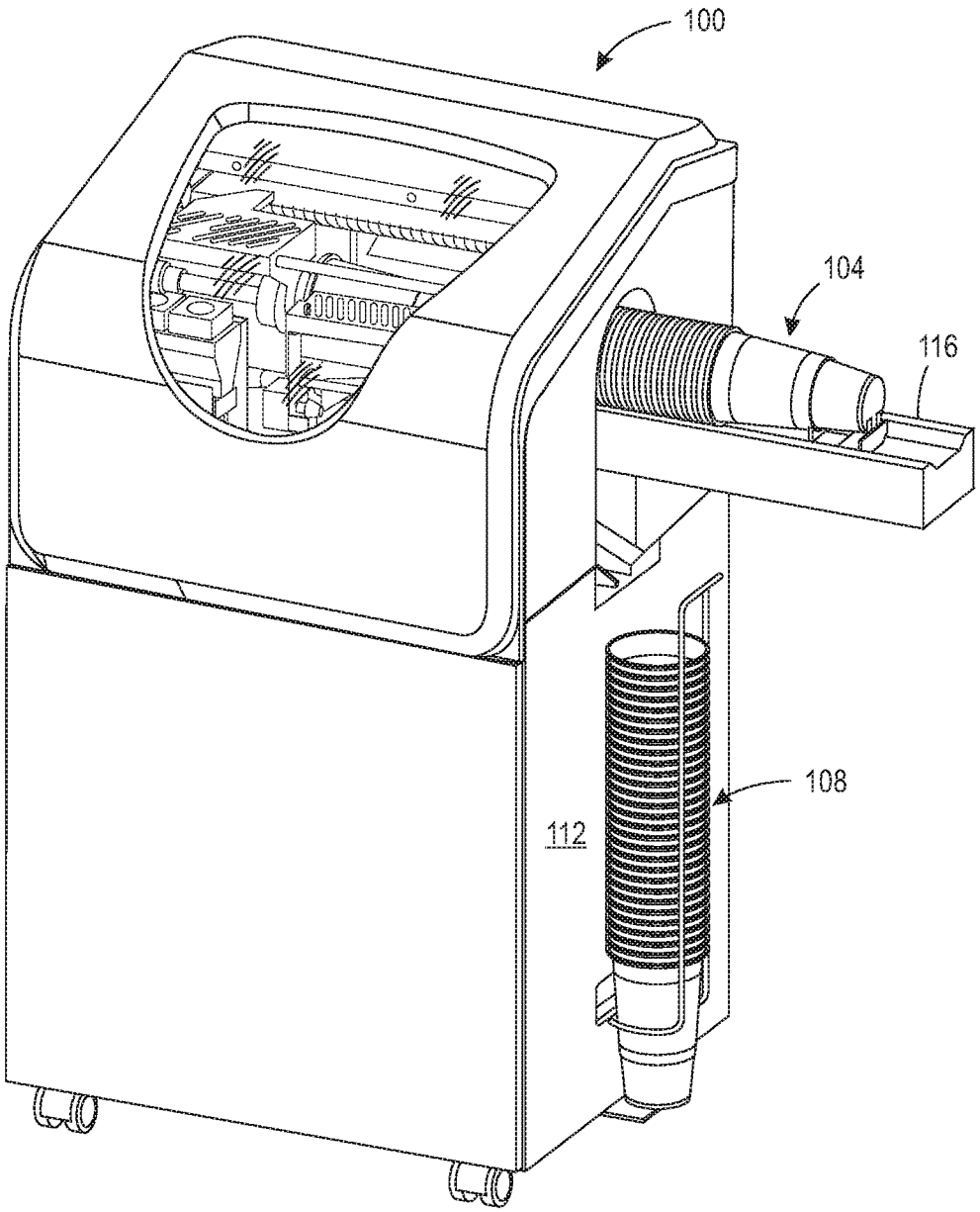
FIG. 1 illustrates an upright printing system to feed objects from a nested stack of objects to the system for printing.

For a general understanding of the present embodiments, reference is made to the drawings. In the drawings, like reference numerals have been used throughout to designate like elements.

Figure 2:
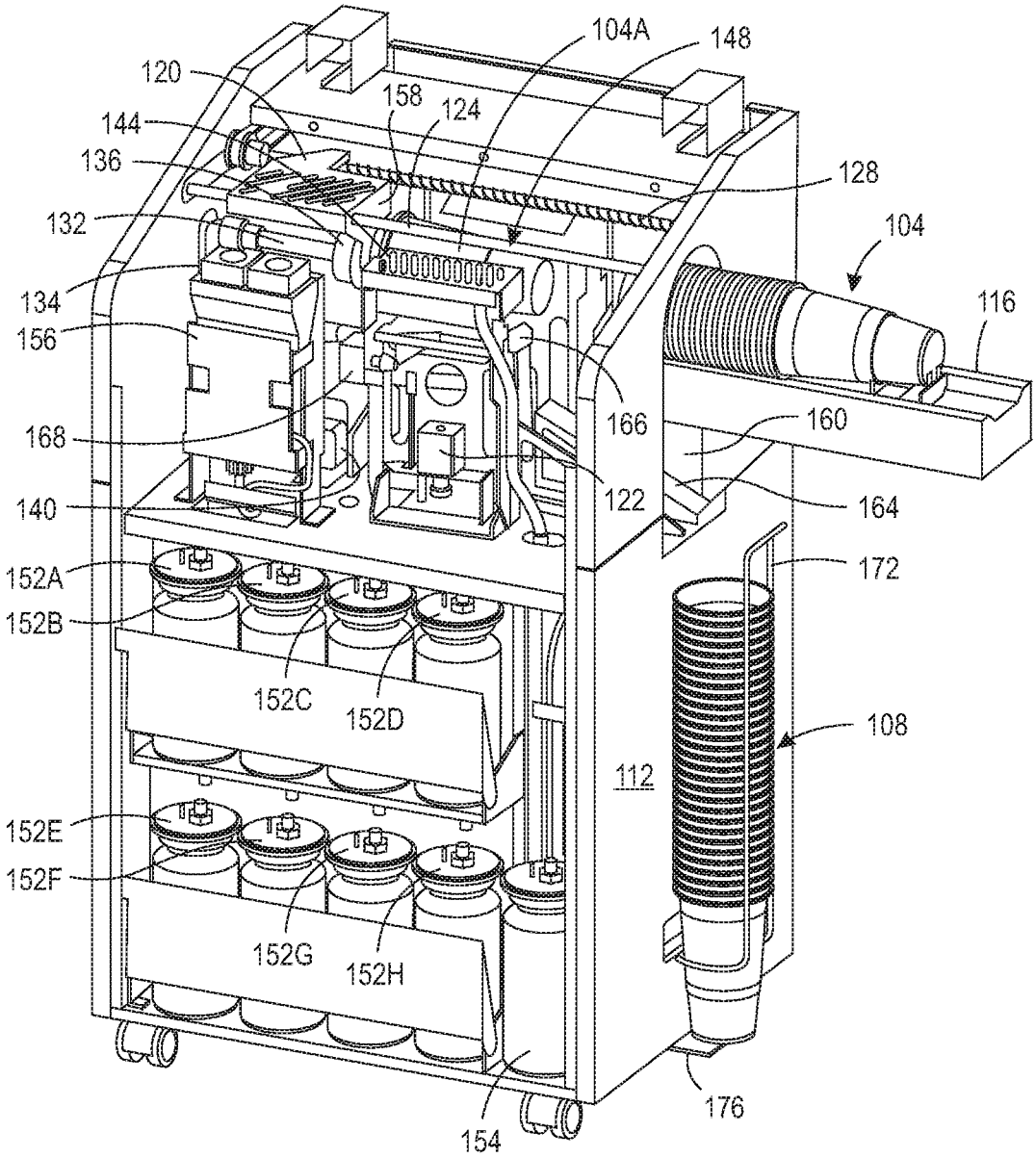
FIG. 2 is the printing system of FIG. 1 with the housing cover removed to expose the internal components that print and discharge the printed objects.

FIG. 1 depicts a printing system 100 configured to retrieve an object from a stack of nested objects 104, print a solid ink image on the surface of the retrieved object, and discharge the printed object into a nested stack 108. The printing system 100 includes a housing 112 in which a printer is positioned as shown in FIG. 2 for the printing of objects. As depicted in the figure, the nested stack of objects is a stack of paper cups although the nested stack can be of any fibrous objects capable of being nested together and that present an orifice at one end of the nested stack. The nested stack 104 is positioned within a holder 116 at an opening into the housing 112.

The internal components of the printing system 100 are shown in more detail in FIG. 2. A shuttle 120 is mounted on a support member 124 for reciprocating movement along the member. A fixed pitch screw member 128 is operatively connected to the shuttle 120 and an actuator 122 so the actuator can bidirectionally rotate the screw member 128 to move the shuttle bidirectionally along the member 124. The shuttle 120 is operatively connected to a rod 132 that terminates into a spindle 136. The rod 132 is hollow to provide a conduit that pneumatically connects spindle 136 to a vacuum source 140. As the spindle 136 travels with the shuttle 120 toward the stack 104, the spindle enters an orifice of the first object in the nested stack of objects in stack 104. One or more holes in the spindle 136 enables the vacuum source 140 to pull air from within the orifice of the first object and mate the interior of the object with the spindle 136.

When the actuator 122 is operated to reverse rotation of the screw member 128, the shuttle 120 returns to its home position, which positions the object 104A opposite two arrays of printheads 144 and 148, one on each side of the object. Each array 144 and 148 has four printheads, although fewer or more printheads can be configured within each array. The eight printheads in the two arrays 144 and 148 are operatively connected to solid ink supplies 152A to 152H, respectively, so each printhead is individually and independently supplied by only one ink supply in the system 100. Ink is provided to a supply in solid form and melted as needed to form liquid ink that is supplied to the printheads in a known manner. Another container 154 is provided to a printhead maintenance system in the printer for the collection of waste ink from purging operations of the printheads. An actuator 134 operatively connected to the rod 132 rotates the rod so the spindle 136 rotates with the object 104A. A forced air heater 168 is positioned to direct heated air toward the surface of the object 104A while the object is opposite the printhead arrays 144 and 148. As the forced air heater directs heated air toward the rotating object, the controller 156 operates the printheads within the printhead arrays 144 and 148 to print text and graphics onto the object 104A with up to eight different colors of solid ink. After the object 104A is printed, the controller disconnects the vacuum source 140 from the rod 132 and the spindle 136 so the weight of the object dislodges the object from the spindle 136. In some embodiments, the position at which the spindle stops to position the object opposite the completed, the controller operates the actuator to continue moving the object away from the stack so the edge of the object encounters the stop to push the object off the spindle as an alternative scheme for releasing the object from the spindle.

The lower portion of the opening 160 through which the holder 116 extends is located at one end of a ramp 164. The other end of the ramp 164 is operatively connected to an actuator 166 to move the other end of the ramp 164 toward and away from the trailing end of the object 104A positioned on the spindle 136. When an object is released from the spindle, gravity directs the object onto the ramp 164, which had its other end raised by the controller 156 operating the actuator 166 once the printing is finished. The object slides along the ramp 164 through the lower portion of the opening 160 and is aligned with previously ejected objects by the guide 172. A tab 176 is mounted to the housing 112 to support the stack of discharged objects within the guide 172. When a run of objects for a particular text and graphics pattern has been printed and discharged, the stack can be removed from the guide 172 so a stack of objects can be printed with another pattern of text and graphics.

Figure 3:
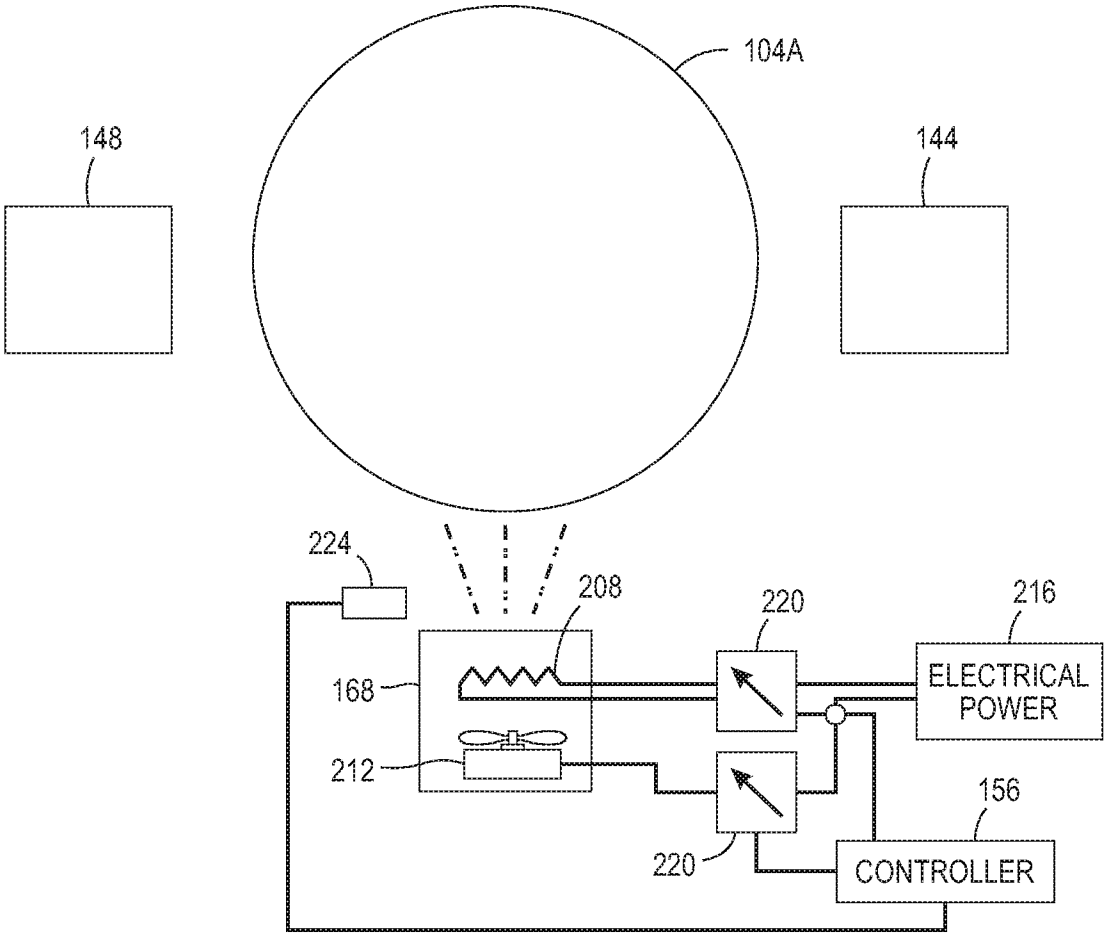
FIG. 3 is a side perspective view of the conveyor that moves a stack of nested objects within the printing system of FIG. 1 for printing.

The forced air heater 168 is shown in more detail in FIG. 3. The printhead arrays 144 and 148 as previously noted are configured for use with solid ink and are supplied with melted solid ink in a known manner and operated in a known manner to eject drops of the melted ink onto the surface of the object 104A to form a solid ink image on the object. In order for the solid ink image to affix to the surface of the fibrous object 104A, controller 156 operates a forced air heater 168 to direct heated air towards the surface of the fibrous object 104A. This heating begins as the object approaches the position opposite the printhead arrays and continues until the object is removed from the spindle. The forced air heater 168 can include a heating element 208 and a positive air source 212, such as a fan, that is configured to direct air through or over the heating element to heat air before the air is directed to the surface of the object 104A. The controller 156 is operatively connected to variable switches 220 to regulate the amount of electrical power provided from power source 216 to the heating element 204 and the positive air source 212. The operation of the two variable switches is independent of one another. In this manner, the controller can regulate the temperature of the forced air and the speed of the air flow from the forced air source 204. Additionally, a temperature sensor 224 is operatively connected to the controller 156. The temperature sensor 224 generates a signal indicative of the temperature of the surface of the object 104A and the controller 156 is configured to control the power supplied to the forced air source 212 and the heating element 204 using the signal from the sensor 224. In one embodiment, the air directed toward the object 104A has a temperature in a range of about 230° F. to about 270° F.

The use of the forced air heater 168 before and during printing of the paper cups, such as those used in coffee shops, fast food establishments, or the like, enables the cups to be printed prior to a beverage or hot food stuff being placed in the cup. Solid ink has an advantage in that it has been approved for use on food packaging and other materials that may come in contact with food for human consumption. Preheating the cup surface enables the melted solid ink ejected onto the surface sink into the object surface and be absorbed by the fibers in the object material. This process continues until the cup is removed from the printer and the cooling of the melted ink solidifies the ink within the object surface. This heat processing alone sufficiently affixes the image to the object that ink rub off is not observed until the contents of the cup exceeds 300° F., which is well above a safe temperature of food stuffs for human consumption. Thus, a printer forming solid ink images on paper cups and fixing the images with heated air can be provided at a food service location to enable blank cups or cups pre-printed with a business' logo to be custom printed with a customer's name, order, mixture ingredients, or the like as the customer's order is being prepared.

Figure 4:
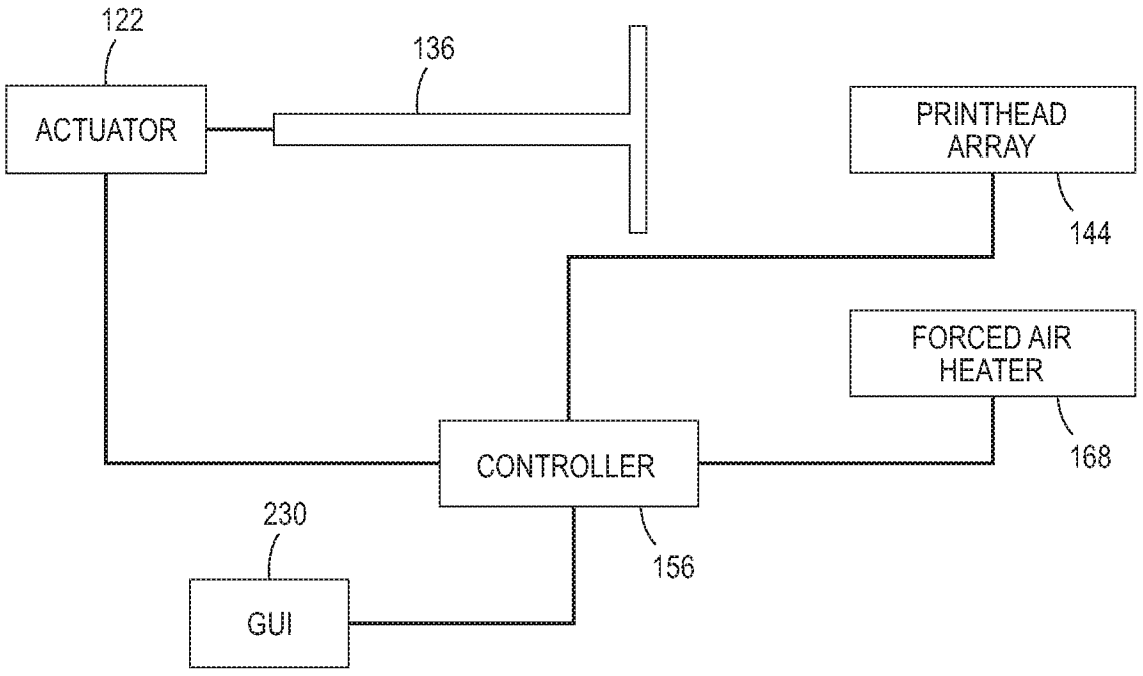
FIG. 4 is a side view of the conveyor shown in FIG. 3 that illustrates the interaction of the helical belt of the conveyor with the nested objects in a stack of nested objects.

An alternative embodiment that can be used in food service embodiments is shown in FIG. 4. In this embodiment, the range of travel for the spindle 136 is longer so the T-shaped end of the spindle in the side view can extend outside the housing of printer. The spindle position shown in the figure holds the object opposite the printhead arrays 144 and 144. At the extended position, a food server can place a paper cup on the spindle. The spindle 136 can be operatively connected to the vacuum source 140 to assist in holding the object to the spindle, although frictional force can be adequate for holding a cup provided the diameter somewhere along the volume of the cup and the diameter of the spindle enable a frictional force to form between the inner cup wall and the spindle. The controller 156 operates the actuator 122 to extend the spindle to the position where the cup can be mounted to the spindle and then the controller 156 operates the actuator 122 to move the cup to a position opposite the printhead arrays 144 and 148 as the controller operates the forced air heater 168 to direct heated air toward the outer surface of the cup. As noted previously, the actuator 122 can also be configured to rotate the cup as the cup is printed. A graphic user interface (GUI) 230 is operatively connected to the controller 156 to enable a food server to enter data, such as a customer's name, order ingredients, or the like, and this data is provided to the controller. The controller 156 uses the data from the GUI to operate the printheads in the printhead arrays to form the text and graphics of the solid ink image formed on the cup. After the cup is printed, the controller 156 operates the actuator 122 to return the spindle 136 to the position that enables the food server to remove the printed cup from the spindle.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printing system comprising:

a plurality of printheads, each printhead in the plurality of printheads being configured to eject solid ink marking material;

a holder configured to hold a stack of nested objects;

a spindle configured for reciprocal movement;

an actuator operatively connected to the spindle to enable the actuator to move the spindle within an orifice of the object in the stack of nested objects that is closest to the plurality of printheads to engage the object and to move the object to a position opposite the plurality of printheads;

a forced air heater configured to direct heated air toward the position opposite the plurality of printheads; and a controller operatively connected to the plurality of printheads, the forced air heater, and the actuator, the controller being configured to operate the actuator to move the spindle within the orifice of the object in the stack of nested objects that is closest to the plurality of printheads to engage the object, remove the object from the stack, and move the object to the position opposite the plurality of printheads, to operate the forced air heater to direct heated air toward the surface of the object opposite the plurality of printheads, and to operate the plurality of printheads to eject solid ink marking material onto the object on the spindle as the forced air heater directs heated air toward the surface of the object.

2. The printing system of claim 1 wherein the actuator is further configured to rotate the spindle and the object on the spindle as the controller operates the plurality of printheads to eject the solid ink marking material on the object.

3. The system of claim 2 further comprising:

a temperature sensor, the temperature sensor being configured to generate a signal indicative of a temperature of the surface of the object; and the controller is operatively connected to the temperature sensor, the controller being further configured to regulate operation of the forced air heater using the signal generated by the temperature sensor.

4. The system of claim 3, the forced air heater further comprising:

a heating element; and a positive air source; and the system further comprises:

an electrical power source;

a first variable switch operatively connected between the electrical power source and the heating element;

a second variable switch operatively connected between the electrical power source and the positive air source; and the controller is operatively connected to the first variable switch and the second variable switch, the controller being configured to operate the first variable switch and the second variable switch using the signal generated by the temperature sensor to regulate the operation of the forced air heater.

5. The system of claim 4, the controller being further configured to operate the first variable switch and the second variable switch independently of one another.

6. The system of claim 5, the controller being further configured to operate the first variable switch to maintain the air directed toward the surface of the object to be within a range of about 230° F. to about 270° F.

7. The printing system of claim 6 further comprising:

a vacuum source that is operatively connected to an opening in the spindle; and the controller is operatively connected to the vacuum source, the controller being further configured to operate the vacuum source in response to the spindle being within the orifice of the object closest to the plurality of printheads and to deactivate the vacuum source in response to printing of an object by the plurality of printheads being completed.

8. A system for printing fibrous objects with solid ink images comprising:

a plurality of printheads, each printhead in the plurality of printheads being configured to eject solid ink marking material;

a spindle configured for reciprocal movement;

an actuator operatively connected to the spindle to enable the actuator to move the spindle to a first position where a fibrous object can be placed on or removed from the spindle and to move the spindle to a second position where the fibrous object is opposite the plurality of printheads;

a forced air heater configured to direct heated air toward the second position where the fibrous object is opposite the plurality of printheads; and a controller operatively connected to the plurality of printheads, the forced air heater, and the actuator, the controller being configured to operate the actuator to move the spindle to the first position to enable the fibrous object to be placed on the spindle and then move the fibrous object to the second position opposite the plurality of printheads, to operate the forced air heater to direct heated air toward the surface of the fibrous object when the fibrous object is at the second position opposite the plurality of printheads, to operate the plurality of printheads to eject solid ink marking material onto the fibrous object on the spindle as the forced air heater directs heated air toward the surface of the fibrous object, and to operate the actuator to return the spindle and the fibrous object to the first position.

9. The system of claim 8 wherein the actuator is further configured to rotate the spindle and the fibrous object on the spindle as the controller operates the plurality of printheads to eject the solid ink marking material on the fibrous object.

10. The system of claim 9 further comprising:

a temperature sensor, the temperature sensor being configured to generate a signal indicative of a temperature of the surface of the fibrous object; and the controller is operatively connected to the temperature sensor, the controller being further configured to regulate operation of the forced air heater using the signal generated by the temperature sensor.

11. The system of claim 10, the forced air heater further comprising:

a heating element; and a positive air source; and the system further comprises:

an electrical power source;

a first variable switch operatively connected between the electrical power source and the heating element;

a second variable switch operatively connected between the electrical power source and the positive air source; and the controller is operatively connected to the first variable switch and the second variable switch, the controller being configured to operate the first variable switch and the second variable switch using the signal generated by the temperature sensor to regulate the operation of the forced air heater.

12. The system of claim 11, the controller being further configured to operate the first variable switch and the second variable switch independently of one another.

13. The system of claim 12, the controller being further configured to operate the first variable switch to maintain the air directed toward the surface of the object to be within a range of about 230° F. to about 270° F.

14. The system of claim 13 further comprising:

a vacuum source that is operatively connected to an opening in the spindle; and the controller is operatively connected to the vacuum source, the controller being further configured to operate the vacuum source to hold the fibrous object on the spindle and to deactivate the vacuum source to release the fibrous object from the spindle.

* * * * *